US010818415B2

(12) United States Patent
Uegaki et al.

(10) Patent No.: US 10,818,415 B2
(45) Date of Patent: Oct. 27, 2020

(54) SHIELDED COMMUNICATION CABLE

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Ryoma Uegaki, Yokkaichi (JP); Keigo Takahashi, Yokkaichi (JP); Kinji Taguchi, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/463,641

(22) PCT Filed: Oct. 20, 2017

(86) PCT No.: PCT/JP2017/038000
§ 371 (c)(1),
(2) Date: May 23, 2019

(87) PCT Pub. No.: WO2018/096854
PCT Pub. Date: May 31, 2018

(65) Prior Publication Data

US 2020/0168366 A1 May 28, 2020

(30) Foreign Application Priority Data

Nov. 28, 2016 (JP) ..... 2016-230174

(51) Int. Cl.
*H01B 11/10* (2006.01)
*H01R 13/6581* (2011.01)
*H01B 7/18* (2006.01)

(52) U.S. Cl.
CPC ..... *H01B 11/10* (2013.01); *H01B 7/1875* (2013.01); *H01R 13/6581* (2013.01)

(58) Field of Classification Search
CPC ... H01B 11/10; H01B 7/1875; H01R 13/6581
(Continued)

(56) References Cited

U.S. PATENT DOCUMENTS 4,559,200 A * 12/1985 Yamasaki ..... C22C 9/00 420/492
4,777,325 A * 10/1988 Siwinski ..... H01B 7/0823 174/34
(Continued)

FOREIGN PATENT DOCUMENTS

JP 2009-181855 A 8/2009
JP 2011-96574 A 5/2011
(Continued)

OTHER PUBLICATIONS

Nov. 21, 2017 International Search Report issued in International Patent Application PCT/JP2017/038000.

*Primary Examiner* — Timothy J Thompson
*Assistant Examiner* — Michael F McAllister
(74) *Attorney, Agent, or Firm* — Oliff PLC

(57) ABSTRACT

A shielded communication cable that includes a twisted wire pair formed by a pair of core wires that each include a conductor and an insulator covering the conductor and that are twisted together; a first sheath covering the pair of core wires that are twisted together; a shield layer covering the first sheath; and a second sheath covering the shield layer, wherein: the shielded communication cable does not include
(Continued)

a drain wire, the shield layer is formed by a multilayer body that includes a metal foil layer and a resin layer disposed on one surface of the metal foil layer, and the shielded communication cable is used for communications in an automobile.

6 Claims, 2 Drawing Sheets

(58) Field of Classification Search
USPC ..... 174/350
See application file for complete search history.

(56) References Cited

U.S. PATENT DOCUMENTS 4,873,393 A * 10/1989 Friesen ..... H01B 11/02 174/34
5,283,390 A * 2/1994 Hubis ..... H01B 11/10 156/51
5,734,126 A * 3/1998 Siekierka ..... H01B 11/002 174/113 R
5,770,820 A * 6/1998 Nelson ..... C08K 5/0066 174/113 R
6,153,826 A * 11/2000 Kenny ..... H01B 11/02 174/113 R
6,211,467 B1 * 4/2001 Berelsman ..... H01B 7/1895 174/113 C
6,323,427 B1 * 11/2001 Rutledge ..... H01B 11/02 174/113 R
6,815,611 B1 * 11/2004 Gareis ..... H01B 11/1025 174/36
7,030,321 B2 * 4/2006 Clark ..... H01B 11/02 174/113 R
8,872,031 B2 * 10/2014 Hinoshita ..... H01B 7/29 174/113 R
9,805,844 B2 * 10/2017 Bopp ..... H01B 11/08
2003/0070831 A1 * 4/2003 Hudson ..... H01B 7/295 174/113 R
2007/0068696 A1 * 3/2007 Matsui ..... H01B 11/1025 174/113 R
2010/0200267 A1 * 8/2010 Baeck ..... H01B 11/06 174/110 R
2011/0042120 A1 2/2011 Otsuka et al.
2011/0100682 A1 5/2011 Nonen et al.
2014/0262424 A1 * 9/2014 Liptak ..... H01B 11/1091 174/106 R
2016/0042842 A1 * 2/2016 Crouse ..... H01B 13/14 425/505
2017/0213621 A1 * 7/2017 Cornelison ..... H01B 11/08
2017/0302010 A1 10/2017 Urashita et al.

FOREIGN PATENT DOCUMENTS

JP 2012-038637 A 2/2012
JP 2012-109128 A 6/2012
JP 2014-157709 A 8/2014
WO 2016/052506 A1 4/2016

* cited by examiner

SHIELDED COMMUNICATION CABLE

This application is the U.S. National Phase of PCT/JP2017/038000 filed Oct. 20, 2017, which claims priority to JP 2016-230174 filed Nov. 28, 2016, the entire disclosure of which is incorporated herein by reference.

BACKGROUND

The present invention relates to a shielded communication cable.

The demands for high-speed communication has been increasing in the automobile field. In such high-speed communications, shielded communication cables that can transmit differential signals are generally used from the viewpoint of noise countermeasures. An example of shielded communication cables for transmitting differential signals is disclosed in JP 2011-96574A.

JP 2011-96574A discloses a shielded communication cable that includes a twisted wire pair obtained by twisting a pair of core wires that each include a conductor and an insulator covering the conductor, a metal foil shield covering the twisted wire pair, a drain wire conductively connected to the metal foil shield, and a sheath covering the entirety of these.

SUMMARY

However, conventional technology has problems in the following points. That is, there are two propagation modes in communications using a shielded communication cable that transmits differential signals, that is, a differential mode in which signal components are transmitted and a common mode in which noise components are transmitted. For example, in a twisted wire pair, differential mode signals that have the same voltage and a phase difference of 180 degrees normally flow through two core wires. However, when the balancing of twists in the twisted wire pair deteriorates, a common mode voltage is generated between the core wires and a drain wire, and a common mode signal that propagates through the drain wire rather than the core wires is generated (hereinafter such a phenomenon will be referred to as a conversion from the differential mode to the common mode).

Particularly, in a shielded communication cable that has a configuration as disclosed in JP 2011-96574A, electromagnetic coupling occurs not only between the core wires of the twisted wire pair but also between the core wires and the metal foil shield, and the common mode impedance decreases. Therefore, conventional shielded communication cables have problems in that a mode conversion amount from the differential mode to the common mode significantly increases and communication properties deteriorate.

An exemplary aspect of the disclosure provides a shielded communication cable that can reduce a mode conversion amount from the differential mode to the common mode.

One aspect of the present invention provides a shielded communication cable including: a twisted wire pair formed by a pair of core wires that each include a conductor and an insulator covering the conductor and that are twisted together; a first sheath covering the pair of core wires that are twisted together; a shield layer covering the first sheath; and a second sheath covering the shield layer, wherein: the shielded communication cable does not include a drain wire, the shield layer is formed by a multilayer body that includes a metal foil layer and a resin layer disposed on one surface of the metal foil layer, and the shielded communication cable is used for communications in an automobile.

Another aspect of the present invention provides a shielded communication cable including: a twisted wire pair formed by a pair of core wires that each include a conductor and an insulator covering the conductor and that are twisted together; a first sheath covering the pair of core wires that are twisted together; a shield layer covering the first sheath; and a second sheath covering the shield layer, wherein: the shield layer is formed by a multilayer body that includes a metal foil layer and a resin layer disposed on one surface of the metal foil layer, an eccentricity ratio of the first sheath is 80% or more, the eccentricity ratio being calculated using an expression 100×(minimum thickness of the first sheath)/(maximum thickness of the first sheath) in a cross-sectional view perpendicular to a cable axis direction, and the shielded communication cable is used for communications in an automobile.

The above-described shielded communication cable has the above-described configuration. Accordingly, there is a physical distance between the core wires and the shield layer in the above-described shielded communication cable owing to the presence of the first sheath disposed between the twisted wire pair and the shield layer, and therefore it is possible to weaken electromagnetic coupling between the core wires and the shield layer. This results in suppression of the mode conversion from the differential mode to the common mode, which would otherwise be caused by electromagnetic coupling between the core wires and the shield layer. Therefore, it is possible to reduce the mode conversion amount from the differential mode to the common mode according to the above-described shielded communication cable.

DETAILED DESCRIPTION OF EMBODIMENTS

Figure 1:
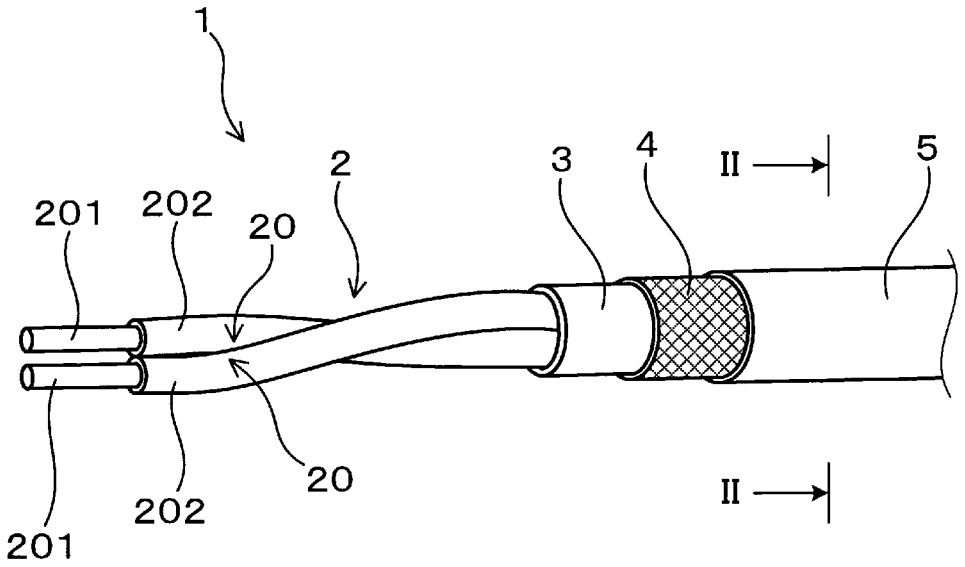
FIG. 1 is an explanatory diagram schematically illustrating a configuration of a shielded communication cable according to a first reference example.

The above-described shielded communication cable may have a configuration in which a distance dc between the conductors of the pair of core wires and a shortest distance ds between the shield layer and each of the conductors of the core wires satisfies $dc \leq ds$.

According to this configuration, electromagnetic coupling between the conductors of the core wires and the shield layer can be reduced more easily, and it is possible to obtain a shielded communication cable that can greatly reduce the mode conversion amount.

Note that dc is specifically the shortest distance between a surface of the conductor of one of the core wires and a surface of the conductor of the other core wire. Further, ds is specifically the shortest distance between a surface of the shield layer on the core wires side and the surface of each of the conductors of the core wires. Further, dc and ds are measured in a cross section perpendicular to a cable axis direction of the shielded communication cable.

For example, dc can be selected from a range of at least 0.4 mm and no greater than 0.7 mm. For example, ds can be selected from a range of at least 0.7 mm and no greater than 1 mm, and preferably from a range of greater than 0.7 mm and no greater than 1 mm.

The above-described shielded communication cable may have a structure (hereinafter may be referred to as a hollow structure) that includes a gap between the twisted wire pair and the first sheath.

According to this configuration, an increase in the dielectric constant of the surrounding of the twisted wire pair can be suppressed by the presence of the gap between the twisted wire pair and the first sheath. Therefore, according to this configuration, it is easy to reduce the thickness of the insulators of the core wires while maintaining a required characteristic impedance compared to a structure (hereinafter may be referred to as a solid structure) that includes substantially no gap between the twisted wire pair and the first sheath. Therefore, this configuration is advantageous for reducing the diameter of the shielded communication cable.

Note that the above-described gap can be formed by covering an outer periphery of the twisted wire pair with the first sheath in a tubular shape by extrusion, for example.

In the above-described shielded communication cable, the twist pitch of the twisted wire pair is preferably 40 mm or less.

According to this configuration, adverse influence on processability and cable properties tends to be suppressed even when the above-described hollow structure is employed, and it is possible to obtain a shielded communication cable that can be stably produced.

From the viewpoint of making it difficult for the first sheath to enter the site between the two core wires and suppressing a reduction in the eccentricity ratio of the first sheath, for example, the above-described twist pitch can be set to preferably 38 mm or less, more preferably 35 mm or less, and further preferably 30 mm or less. From the viewpoint of productivity, for example, the above-described twist pitch can be set to preferably 10 mm or more, more preferably 15 mm or more, and further preferably 18 mm or more.

From the viewpoint of suppressing adverse influence on cable processability and cable properties, for example, the eccentricity ratio of the first sheath can be set to preferably 80% or more, more preferably 82% or more, and further preferably 84% or more. From the viewpoint of productivity, for example, the eccentricity ratio of the first sheath can be set to 95% or less, for example. Note that the eccentricity ratio of the first sheath is a value calculated using the following expression 100×(minimum thickness of first sheath)/(maximum thickness of first sheath) in a cross-sectional view perpendicular to the cable axis direction of the shielded communication cable.

In the above-described shielded communication cable, the shield layer is constituted by a multilayer body that includes a metal foil layer and a resin layer disposed on one surface of the metal foil layer. According to this configuration, the multilayer body can be longitudinally attached to the outer periphery of the first sheath while the second sheath is formed by, for example, extrusion coating, and therefore it is possible to produce the above-described shielded communication cable relatively easily compared to a case where the shield layer is constituted by a braided wire. Specifically, the above-described multilayer body may be arranged such that the metal foil layer faces the first sheath and the resin layer faces the second sheath, or the resin layer faces the first sheath and the metal foil layer faces the second sheath. The former arrangement of the multilayer body is preferable. More specifically, the above-described multilayer body may include a metal foil layer, a resin layer disposed on an outer surface of the metal foil layer, and an adhesive layer disposed on an outer surface of the resin layer. According to this configuration, the adhesive layer of the shield layer constituted by the above-described multilayer body can adhere to an inner surface of the second sheath. Therefore, it is possible to obtain a shielded communication cable that has an excellent peeling property, because the shield layer can also be peeled off when the second sheath is peeled off. Note that examples of metal foil (metal also encompasses metal alloys) used for the shield layer include aluminum, an aluminum alloy, copper, and a copper alloy.

The above-described shielded communication cable preferably has a characteristic impedance of at least 90Ω and no greater than 110Ω, that is, in a range of 100±10Ω.

According to this configuration, it is possible to obtain a shielded communication cable that is suitable for high-speed communications such as Ethernet (registered trademark of Fuji Xerox Co., Ltd.; this statement will be omitted hereinafter) communications.

The above-described shielded communication cable can greatly reduce the mode conversion amount, and therefore can be suitably used for communications in an automobile, for example, which require excellent high-speed communication performance.

Note that the above-described configurations can be combined as necessary to achieve the above-described functions and effects.

EMBODIMENTS

First Reference Example

Figure 2:
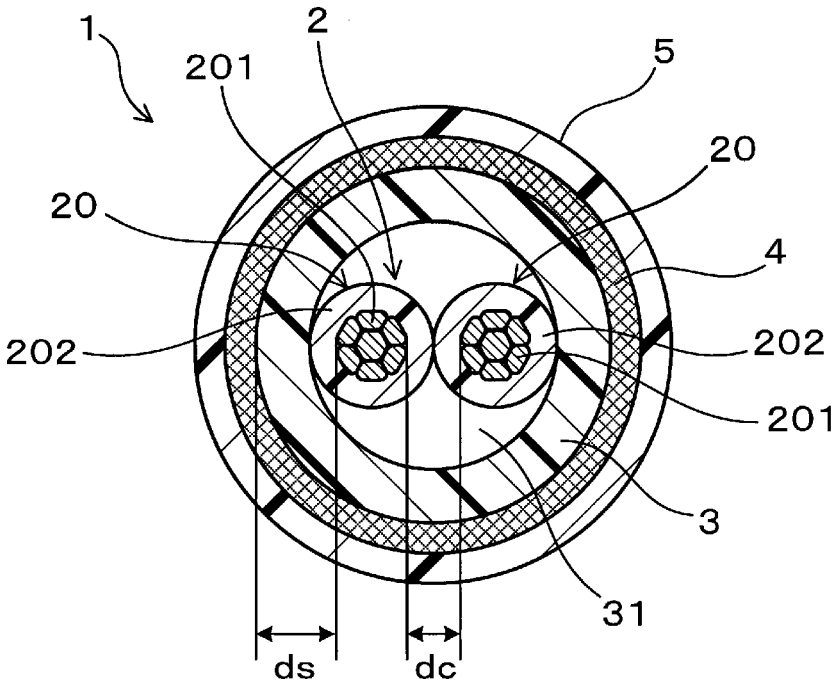
FIG. 2 is a cross-sectional view taken along line II-II in FIG. 1.

The following describes a shielded communication cable according to a first reference example with reference to FIGS. 1 and 2. As illustrated in FIGS. 1 and 2, a shielded communication cable 1 of the present embodiment includes a twisted wire pair 2, a first sheath 3, a shield layer 4, and a second sheath 5.

The twisted wire pair 2 includes a pair of core wires 20 and 20 that each include a conductor 201 and an insulator 202 covering the conductor 201. The pair of core wires 20 and 20 are twisted together.

In the present embodiment, the material of the conductor 201 can be selected from copper, a copper alloy, aluminum, and an aluminum alloy, for example. The cross-sectional area of the conductor 201 can be set in a range from 0.08 to 0.35 $mm^2$, for example. Note that the conductor 201 may be constituted by a single strand or a twisted wire conductor that is obtained by twisting a plurality of strands. The material of the insulator 202 can be selected from various wire coating resins, examples of which include polyolefins such as polypropylene and vinyl chloride-based resins such as soft polyvinyl chloride. The thickness of the insulator 202 can be set in a range from 0.14 to 0.35 mm, for example. The twist pitch of the twisted wire pair 2 can be set to 40 mm or less, for example.

The first sheath 3 covers the twisted wire pair 2. In the present embodiment, the material of the first sheath 3 can be selected from polyolefins such as polypropylene and vinyl chloride-based resins such as soft polyvinyl chloride, for example. The thickness of the first sheath 3 can be set in a range from 0.15 to 1.5 mm, for example. Note that the drawing shows a gap 31 formed between the twisted wire pair 2 and the first sheath 3. That is, the shielded communication cable 1 of the present embodiment has a hollow structure.

The shield layer 4 covers the first sheath 3. In the present embodiment, the shield layer 4 is constituted by a braided wire that covers an outer periphery of the first sheath 3. The braided wire is obtained by braiding a plurality of metal (or metal alloy) strands into a tubular shape. Examples of metal strands that can be used include copper wires, copper alloy wires, aluminum wires, aluminum alloy wires, and stainless steel wires. The diameter of each strand can be set in a range from 0.12 to 0.36 mm, for example.

The second sheath 5 covers the shield layer 4. In the present embodiment, the material of the second sheath 5 can be selected from polyolefins such as polypropylene and vinyl chloride-based resins such as soft polyvinyl chloride, for example. The thickness of the second sheath 5 can be set in a range from 0.30 to 0.80 mm, for example. Note that the drawing shows the second sheath 5 in close contact with a surface of the shield layer 4.

In the shielded communication cable 1 of the present embodiment, a distance dc between the conductors of the pair of core wires 20 and 20 and the shortest distance ds between the shield layer 4 and each of the conductors 201 of the core wires 20 satisfies dc ds as illustrated in FIG. 2.

Second Embodiment

Figure 3:
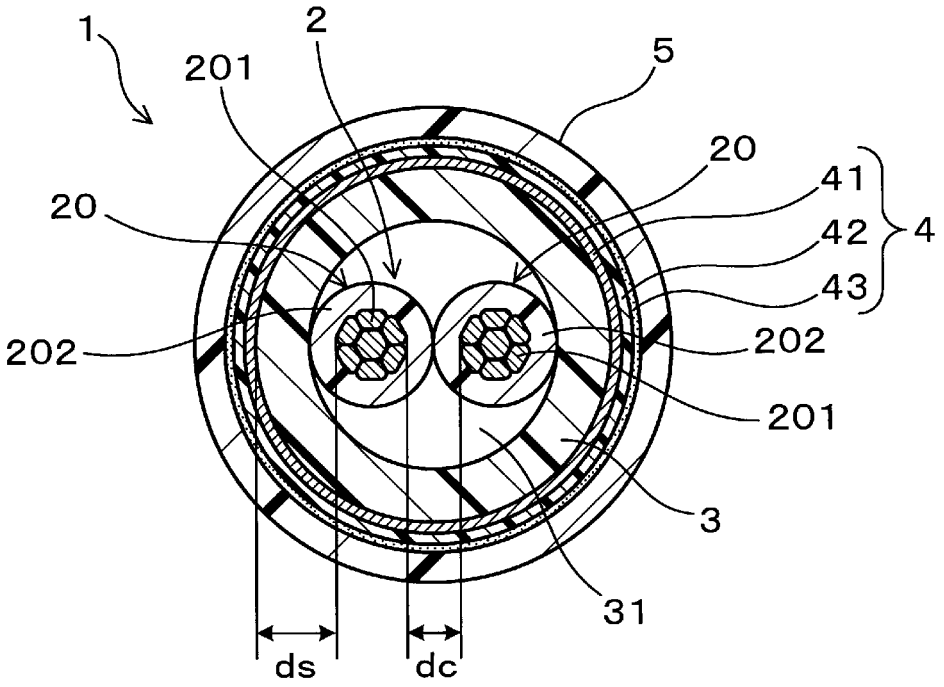
FIG. 3 is a cross-sectional view of a shielded communication cable according to a second embodiment, corresponding to the cross-sectional view of FIG. 2.

The following describes a shielded communication cable according to a second embodiment with reference to FIG. 3. In the shielded communication cable 1 of the present embodiment, the shield layer 4 is constituted by a multilayer body that includes a metal foil layer 41, a resin layer 42 disposed on an outer surface of the metal foil layer 41, and an adhesive layer 43 disposed on an outer surface of the resin layer 42. In the present embodiment, for example, an aluminum foil layer can serve as the metal foil layer. The thickness of the metal foil layer can be set in a range from 5 to 200 μm, for example. A polyester layer such as a polyethylene terephthalate layer can serve as the resin layer, for example. The thickness of the resin layer can be set in a range from 10 to 100 μm, for example. An EVA-based adhesive layer can serve as the adhesive layer, for example. The adhesive layer of the shield layer 4 constituted by the multilayer body adheres to an inner surface of the second sheath 5. Other configurations are the same as those in the first reference example.

Experimental Examples

The following describes the above-described shielded communication cables more specifically using experimental examples.

Production of Shielded Communication Cables

Twisted wire pairs were each produced by twisting two core wires that were each obtained by covering an outer periphery of a conductor formed from a copper alloy wire with an insulator by extrusion. The cross-sectional area of the conductor, the material and thickness of the insulator, and the twist pitch were as shown in Tables 1 and 2.

Next, an outer periphery of the twisted wire pair was covered with a first sheath by extrusion. The material, thickness, and eccentricity ratio of the first sheath were as shown in Tables 1 and 2. The structure between the twisted wire pair and the first sheath was a hollow structure or a solid structure as shown in Tables 1 and 2.

Next, an outer periphery of the first sheath was covered with a braided wire that was obtained by braiding tin-plated soft copper strands. The diameter and braiding structure (the number of strand bundles/the number of strands) of the tin-plated soft copper strands used for the braided wire were as shown in Table 1. Alternatively, the outer periphery of the first sheath was covered with a multilayer body having a multilayer structure constituted by aluminum foil/PET/adhesive, or a multilayer body having a multilayer structure constituted by aluminum foil/PET, as shown in Table 2. Note that each multilayer body was disposed such that the aluminum foil layer faces the first sheath.

Next, a second sheath was extruded so as to surround the braided wire. The material and thickness of the second sheath were as shown in Tables 1 and 2. Thus, shielded communication cables of Samples 1 to 13 each having predetermined dc and ds were produced.

Further, a shielded communication cable of Sample 1C was produced in a manner similar to those in production of the shielded communication cables of Samples 1 to 8, except that the first sheath was not used for covering. Similarly, a shielded communication cable of Sample 2C was produced in a manner similar to those in production of the shielded communication cables of Samples 9 to 13, except that the first sheath was not used for covering.

Measurement of Characteristic Impedance and Mode Conversion Amount

A characteristic impedance and a mode conversion amount of the shielded communication cable of each sample were measured. The characteristic impedance was measured by the Time Domain Reflectometry (TDR) method. The mode conversion amount was measured using a network analyzer. The shielded communication cables were evaluated at an environmental temperature of 23° C.

Detailed configurations of the produced samples of shielded communication cables and measurement results of the characteristic impedance and the mode conversion amount are shown in Tables 1 and 2.

TABLE 1

| | Shielded communication cable | | | | | | | | | | | | | | | |
|---|---|---|---|---|---|---|---|---|---|---|---|---|---|---|---|---|
| | Twisted wire pair | | | | First sheath | | | | Shield layer (braided wire) | | Second sheath | | | | | |
| Sample | Conductor cross-sectional area ($mm^2$) | Insulator Material | Insulator Thickness (mm) | Twist pitch (mm) | Material | Structure | Thickness (mm) | Eccentricity ratio (%) | Wire diameter ϕ (mm) | Configuration number of strands bundles/number of strands | Material | Thickness (mm) | dc (mm) | ds (mm) | Characteristic impedance (Ω) | Mode conversion amount (db) |
| 1 | 0.13 | PP | 0.25 | 25 | PP | Hollow | 0.45 | 85 | 0.16 | 12/8 | PP | 0.4 | 0.5 | 0.7 | 101 | −48 |
| 2 | 0.13 | PP | 0.25 | 25 | PP | Hollow | 0.35 | 86 | 0.16 | 12/8 | PP | 0.4 | 0.5 | 0.6 | 98 | −40 |
| 3 | 0.13 | PP | 0.25 | 25 | PP | Hollow | 0.25 | 86 | 0.16 | 12/8 | PP | 0.4 | 0.5 | 0.5 | 96 | −36 |
| 4 | 0.13 | PP | 0.25 | 25 | PP | Hollow | 0.15 | 85 | 0.16 | 12/8 | PP | 0.4 | 0.5 | 0.4 | 92 | −24 |
| 5 | 0.13 | PP | 0.25 | 25 | PP | Solid | 0.45 | 87 | 0.16 | 12/8 | PP | 0.4 | 0.5 | 0.7 | 89 | −49 |
| 6 | 0.13 | PP | 0.30 | 25 | PP | Solid | 0.45 | 88 | 0.16 | 12/8 | PP | 0.4 | 0.6 | 0.8 | 94 | −44 |
| 7 | 0.13 | PP | 0.25 | 40 | PP | Hollow | 0.45 | 80 | 0.16 | 12/8 | PP | 0.4 | 0.5 | 0.7 | 102 | −48 |
| 8 | 0.13 | PP | 0.25 | 55 | PP | Hollow | 0.45 | 72 | 0.16 | 12/8 | PP | 0.4 | 0.5 | 0.7 | 103 | −47 |
| 1C | 0.13 | PP | 0.35 | 25 | — | — | — | — | 0.16 | 12/8 | PP | 0.4 | 0.7 | 0.4 | 99 | −16 |

TABLE 2

| | Shielded communication cable | | | | | | | | | | | | | | | |
|---|---|---|---|---|---|---|---|---|---|---|---|---|---|---|---|---|
| | Twisted wire pair | | | | First sheath | | | | Shield layer | | Second sheath | | | | | |
| Sample | Conductor cross-sectional area ($mm^2$) | Insulator Material | Insulator Thickness (mm) | Twist pitch (mm) | Material | Structure | Thickness (mm) | Eccentricity ratio (%) | Multi-layer structure | Al layer thickness (μm) | Material | Thickness (mm) | dc (mm) | ds (mm) | Characteristic impedance (Ω) | Mode conversion amount (db) |
| 9 | 0.13 | PP | 0.25 | 25 | PP | Hollow | 0.45 | 85 | Al/PET/adhesive | 18 | PP | 0.4 | 0.5 | 0.7 | 105 | −49 |
| 10 | 0.13 | PP | 0.25 | 25 | PP | Hollow | 0.35 | 86 | Al /PET/adhesive | 18 | PP | 0.4 | 0.5 | 0.6 | 101 | −44 |
| 11 | 0.13 | PP | 0.25 | 25 | PP | Hollow | 0.25 | 86 | Al/PET/adhesive | 18 | PP | 0.4 | 0.5 | 0.5 | 98 | −39 |
| 12 | 0.13 | PP | 0.25 | 25 | PP | Hollow | 0.15 | 85 | Al/PET/adhesive | 18 | PP | 0.4 | 0.5 | 0.4 | 94 | −30 |
| 13 | 0.13 | PP | 0.25 | 25 | PP | Hollow | 0.45 | 85 | Al /PET | 18 | PP | 0.4 | 0.5 | 0.7 | 105 | −48 |
| 2C | 0.13 | PP | 0.35 | 25 | — | — | — | — | Al/PET/adhesive | 18 | PP | 0.4 | 0.7 | 0.4 | 98 | −19 |

The following is found from Tables 1 and 2. Samples 1C and 2C do not include the first sheath between the twisted wire pair and the shield layer. Therefore, the mode conversion amount became extremely large in Samples 1C and 2C. This is because, due to the absence of the first sheath between the core wires of the twisted wire pair and the shield layer, the physical distance between the core wires and the shield layer could not be made large enough, and therefore electromagnetic coupling between the core wires and the shield layer could not be weakened and the common mode impedance decreased.

In contrast, the mode conversion amount could be reduced in Samples 1 to 13 compared to the conventional technology. This is because, owing to the presence of the first sheath that was disposed between the twisted wire pair and the shield layer in Samples 1 to 13, the physical distance between the core wires and the shield layer could be made large enough to weaken electromagnetic coupling between the core wires and the shield layer. These results show that it is possible to obtain shielded communication cables suitable for high-speed communications according to Samples 1 to 13 by the effect of suppressing the mode conversion. Furthermore, influence of external noise (magnetic field noise) can be suppressed and processability of a wire harness through terminal crimping or the like can be improved by the use of the twisted wire pair. Therefore, it is possible to obtain shielded communication cables suitable for automobiles according to Samples 1 to 13.

The following is also found from comparison between Samples 1 to 13. From comparison of Samples 1 to 3 with Sample 4, it was confirmed that the effect of reducing the mode conversion amount becomes more significant when dc≤ds is satisfied. This is presumably because electromagnetic coupling between the conductors of the core wires and the shield layer can be greatly reduced when dc≤ds is satisfied. Matter similar to the above can also be said from comparison of Samples 9 to 11 with Sample 12.

Next, from comparison of Sample 1 with Samples 5 and 6, it was confirmed that a reduction in the characteristic impedance can be suppressed more easily in the hollow structure including a gap between the twisted wire pair and the first sheath than in the solid structure including substantially no gap between the twisted wire pair and the first sheath. This is because the dielectric constant of the surrounding of the twisted wire pair increased in the solid structure, whereas an increase in the dielectric constant of the surrounding of the twisted wire pair was suppressed in the hollow structure by the presence of the gap. Further, in the case of the solid structure, it is necessary to increase the thickness of the insulators of the core wires to adjust the characteristic impedance to a desired value, and accordingly the diameter of the cable tends to become large. In contrast, the hollow structure is advantageous for reducing the diameter of the cable because the thickness of the insulators of the core wires can be reduced while maintaining a required characteristic impedance.

Next, from comparison between Samples 1 to 8, it was found that the eccentricity ratio of the first sheath tends to decrease when the twist pitch of the twisted wire pair exceeds 40 mm. This is because it became easier for the first sheath to enter the site between the two core wires by the increase in the twist pitch of the twisted wire pair. Therefore, it was confirmed that the twist pitch of the twisted wire pair is preferably 40 mm or less. Also, it was confirmed that the eccentricity ratio of the first sheath is preferably 80% or more, because an eccentricity ratio of the first sheath of less than 80% may have adverse influence on cable processability and cable properties.

Also, from comparison between Samples 9 to 13, it was confirmed that when the multilayer body having the multilayer structure constituted by aluminum foil/PET/adhesive was used as the shield layer, the peeling property was improved compared to when the multilayer body constituted by aluminum foil/PET was used.

Although the embodiments of the present invention and the experimental examples have been described in detail, the present invention is not limited to the above-described embodiments and experimental examples, and various alterations can be made within a scope where the gist of the present invention is not impaired.

The invention claimed is:

1. A shielded communication cable comprising:

a twisted wire pair formed by a pair of core wires that each include a conductor and an insulator covering the conductor and that are twisted together;

a first sheath covering the pair of core wires that are twisted together;

a shield layer covering the first sheath; and a second sheath covering the shield layer, wherein:

the shielded communication cable does not include a drain wire, the shield layer is formed by a multilayer body that includes a metal foil layer and a resin layer disposed on one surface of the metal foil layer, and a distance dc between the conductors of the pair of core wires that are twisted together and a shortest distance ds between the shield layer and each of the conductors of the pair of core wires that are twisted together satisfies dc≤ds.

2. A shielded communication cable comprising:

a twisted wire pair formed by a pair of core wires that each include a conductor and an insulator covering the conductor and that are twisted together;

a first sheath covering the pair of core wires that are twisted together;

a shield layer covering the first sheath; and a second sheath covering the shield layer, wherein:

the shield layer is formed by a multilayer body that includes a metal foil layer and a resin layer disposed on one surface of the metal foil layer, an eccentricity ratio of the first sheath is 80% or more, the eccentricity ratio being calculated using an expression 100×(minimum thickness of the first sheath)/(maximum thickness of the first sheath) in a cross-sectional view perpendicular to a cable axis direction, and a distance dc between the conductors of the pair of core wires that are twisted together and a shortest distance ds between the shield layer and each of the conductors of the pair of core wires that are twisted together satisfies dc≤ds.

3. A shielded communication cable comprising:

a twisted wire pair formed by a pair of core wires that each include a conductor and an insulator covering the conductor and that are twisted together;

a first sheath covering the pair of core wires that are twisted together;

a shield layer covering the first sheath; and a second sheath covering the shield layer, wherein:

the shielded communication cable does not include a drain wire, the shield layer is formed by a multilayer body that includes a metal foil layer and a resin layer disposed on one surface of the metal foil layer, and the shield layer is formed by the multilayer body that includes the metal foil layer, the resin layer disposed on an outer surface of the metal foil layer that is the one surface of the metal foil layer, and an adhesive layer disposed on an outer surface of the resin layer.

4. The shielded communication cable according to claim 1, wherein there is a gap between the pair of core wires that are twisted together and the first sheath.

5. The shielded communication cable according to claim 1, wherein a twist pitch of the pair of core wires that are twisted together is 40 mm or less.

6. The shielded communication cable according to claim 1, which has a characteristic impedance of at least 90Ω and no greater than 110 Ω.

* * * * *